United States Patent [19]

Baird, Jr.

[11] Patent Number: 4,579,648

[45] Date of Patent: Apr. 1, 1986

[54] CATALYTIC REFORMING PROCESS

[75] Inventor: William C. Baird, Jr., Baton Rouge, La.

[73] Assignee: Exxon Research and Engineering Co., Florham Park, N.J.

[21] Appl. No.: 653,719

[22] Filed: Sep. 24, 1984

[51] Int. Cl.[4] ..... C10G 35/06

[52] U.S. Cl. ..... 208/138; 208/139

[58] Field of Search ..... 208/138, 139

[56] References Cited

U.S. PATENT DOCUMENTS 4,295,957 10/1981 Mauldiz et al. ..... 208/138

4,415,441 11/1983 Markley et al. ..... 208/138

*Primary Examiner*—Curtis R. Davis

*Attorney, Agent, or Firm*—Llewellyn A. Proctor

[57] ABSTRACT

Paraffinic naphthas, the $C_8+$ aromatics content of which is below about 5 wt. % can be reformed to provide higher $C_5+$ LV% yields by blending $C_8+$ aromatics with said naphtha composition to raise the $C_8+$ aromatic concentration above such level. Preferably the addition of the $C_8+$ aromatics to such blend is sufficient to raise the $C_8+$ aromatics level of the blend to concentrations above about 5 wt. %, preferably to concentrations ranging from about 5 wt. % to about 20 wt. %.

8 Claims, 1 Drawing Figure

FIGURE
YIELD CORRELATES WITH $C_8$ + AROMATIC CONTENT
CYCLIC, Pt-Re, 950°F, 275 PSIG, 3700 SCF/B, 100 RON
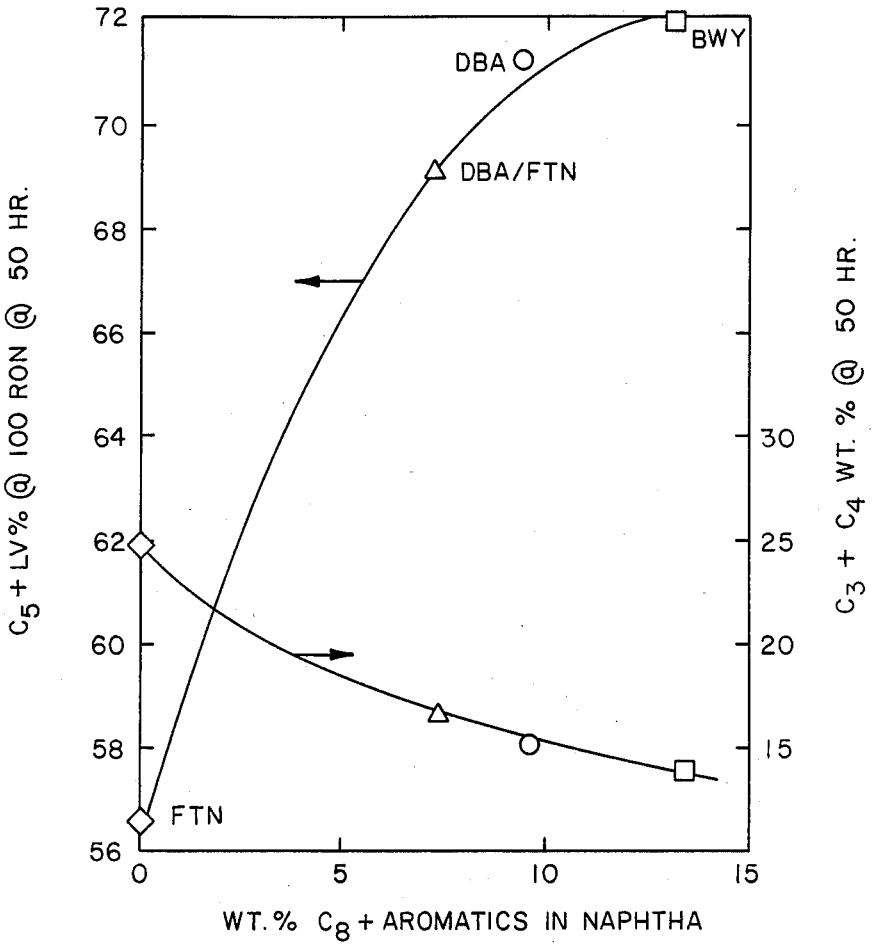

CATALYTIC REFORMING PROCESS

BACKGROUND OF THE INVENTION AND PRIOR ART

I. Field of the Invention

This invention relates to a process for catalytically reforming naphtha, especially to a catalytic reforming process for improving the selectivity, or $C_5+$ liquid yields from paraffinic naphthas.

II. Background and Problems

Catalytic reforming, or hydroforming, is a well established industrial process employed by the petroleum industry for improving the octane quality of naphthas or straight run gasolines. In reforming, a multi-functional catalyst is employed which contains a metal hydrogenation-dehydrogenation (hydrogen transfer) component, or components, substantially atomically dispersed upon the surface of a porous, inorganic oxide support, notably alumina. Noble metal catalysts, notably platinum, and particularly platinum to which one or more metal promoters have been added, are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins which produces gas, and inevitably coke, the latter being deposited on the catalyst.

In a typical process, a series of reactors constitute the heart of the reforming unit. Each reforming reactor is generally provided with fixed beds of the catalyst which receive generally downflow feed, and each is provided with a preheater or interstage heater, because the predominant reactions which take place are endothermic. A naphtha feed, with hydrogen, or hydrogen recycle gas, is concurrently passed through a preheat furnace and reactor, and then in sequence through subsequent heaters and reactors of the series. The sequence of reforming reactions, supra, takes place as a continuum throughout the several reactors of the reforming unit. The product from the last reactor is separated into a liquid fraction, i.e., a $C_5+$ fraction, and a vaporous effluent. The latter is a gas rich in hydrogen, which usually contains small amounts of normally gaseous hydrocarbons ($C_4-$), from which hydrogen is separated and recycled to the process to minimize coke production.

It is generally recognized that reformer yields are highly sensitive to the chemical composition of the naphtha being processed. Naphthas rich in cyclopentanes and cyclohexanes, the so-called naphthenic naphthas, reform readily in high yield due to the ease of aromatization of these native cyclic paraffins. On the other hand, paraffinic naphthas rich in linear paraffinic structures and lean in naphthene content are converted to higher octane products at relatively much lower yields. This is a consequence of the necessity for paraffin dehydrocyclization prior to dehydrogenation which allows competitive cracking reactions to intervene and divert feed paraffins from $C_5+$ liquid product to $C_4-$ gas.

Aside from the historical classification of reformer naphthas into these two general feed types, i.e., paraffinic and naphthenic, it has gone largely unrecognized that further differences in reformability exist within these major feed types. For example, only recently has coal derived naphtha been shown to be the most easily processed of the naphthenic types due to its high aromatic and $C_6$-naphthene content. No such distinction has emerged among the paraffinic naphthas, or naphthas of composition containing generally from about 30 percent to about 100 percent paraffinic hydrocarbons, and more typically from about 50 percent to about 100 percent paraffinic hydrocarbons, based on the total volume of the composition, with the balance of the naphtha composition being constituted of naphthenes, aromatics, and other hydrocarbons. All paraffinic naphthas are viewed of equal reformability.

III. The Invention

It has now been discovered that paraffinic naphthas, supra, the $C_8+$ aromatics (aromatics having 8 carbon atoms and greater) content of which is below about 5 wt. % percent, based on the total composition can be reformed to provide higher $C_5+$ liquid yields by blending $C_8+$ aromatics with said naphtha composition to raise the $C_8+$ aromatics concentration above said 5 wt. % percent level, and preferably above a 10 wt. % percent level. The addition of the $C_8+$ aromatics to such blend is sufficient to raise the $C_8+$ aromatics level of the blend to concentrations ranging from about 5 wt. % percent to about 20 wt. % percent, preferably from about 10 wt. % percent to about 15 wt. % percent, based on the total composition. In accordance with this invention, it has thus been discovered that the $C_5+$ liquid yield response of a paraffinic naphtha is a function of the $C_8+$ aromatics content of the naphtha. As the $C_8+$ aromatics content of a naphtha is increased, the $C_5+$ liquid yield obtained from such naphtha on reforming also rises due to a corresponding decrease in acid catalyzed cracking reactions. This change in the reforming chemistry is believed to result from the interaction of the heavy $C_8+$ aromatics with surface acid sites wherein the $C_8+$ aromatics are protonated by Bronsted sites and bind to the surface as an organic carbocation. This surface ion provides a medium for the protonation and isomerization of feed paraffins without cracking due to the stabilization of the reacting ions by the charged organic matrix. Paraffins encountering "naked" Bronsted sites crack subsequent to protonation in the absence of this stabilizing organic ion.

The significance of this discovery lies in the dependency of yield on the $C_8+$ aromatics fraction, as a consequence of which yield can be increased simply by blending additional $C_8+$ aromatics into naphthas containing no aromatic compounds, or into naphthas whose $C_8+$ aromatic content is low, e.g., as where the $C_8+$ aromatic content has been reduced by fractionation intended to direct the heavier naphtha hydrocarbons to mid-distillate. The $C_8+$ aromatics may be obtained from any suitable source, e.g., a refinery stream provided the feed purity specifications required are satisfied. A useful source of $C_8+$ aromatics for this purpose is, e.g., a BTX raffinate, a hydrofined heavy cat naphtha, or a hydrocrackate.

The paraffinic naphtha can be a blend of a virgin naphtha, cracked naphtha, a Fischer-Tropsch naphtha, or the like. Typical feeds are constituted of hydrocarbons containing from about 5 to 12 carbon atoms, or more preferably from about 6 to about 9 carbon atoms. Paraffinic naphthas, or petroleum fractions boiling within the range of from about 80° F., to about 450° F., and preferably from about 125° F. to about 375° F., contain hydrocarbons of carbon numbers within these ranges. Typical fractions useful for the purpose of this invention thus usually contain from about 30 to about 100 wt. % paraffins, preferably from about 50 to about 100 wt. % paraffins, both normal and branched, which fall in the range of about $C_5$ to $C_{12}$, from about 10 to 70 wt. % of naphthenes, preferably from about 10 to about 60 wt. % naphthenes, falling within the range of from about $C_6$ to $C_{12}$, and from about 5 to about 30 wt. %, preferably from about 5 to about 20 wt. % of aromatics falling within the range of from about $C_6$ to $C_{12}$. Whatever the concentration of $C_6$ and $C_7$ aromatics, however, in the practice of this invention the blend will constitute from about 5 to about 20 wt. %, preferably from about 10 to about 15 wt. %, of the total aromatics as $C_8$+ aromatics.

The $C_8$+ aromatics naphtha blend is processed over a platinum catalyst, preferably a platinum-containing polymetallic catalyst formed by the addition of other metallic components to platinum to promote and further improve the activity or selectivity, or both, of the basic platinum catalyst, e.g., iridium, rhenium, iridium and rhenium, tin, or the like. Among the new generation bi-metallic catalysts, platinum-iridium catalysts possess superior activity for use in reforming operations as compared with platinum catalysts. These catalysts also possess good selectivity as contrasted with platinum catalysts, selectivity being defined as the ability of the catalyst to produce high yields of $C_5$+ liquid products with concurrent low production of normally gaseous hydrocarbons, i.e., methane and other gaseous hydrocarbons, and coke. Platinum-rhenium catalysts are particularly desirable in that they are more selective, and produce higher $C_5$+ liquid yields than most other promoted platinum catalysts.

In preparing such catalysts it is preferred to deposit the platinum metal, or platinum and other metals, e.g., the platinum and iridium or platinum and rhenium metals, and other metals or non-metals used as promoters, on a previously pilled, pelleted, beaded, extruded, or sieved particulate support material, suitably by impregnation. Pursuant to the impregnation method, porous refractory inorganic oxides, especially alumina, in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent filtration or evaporation to effect total uptake of the metallic component, or components.

The impregnation solutions of the noble metal compound, and metals or other compounds used as promoters, are prepared by dissolving the compounds, or salts, in water or other inorganic or organic solvents. The concentration of the metallic components generally ranges from about 0.01 to 5 percent, preferably from about 0.05 to 1 percent, based on the weight of solution. The pH of the impregnation solution should be controlled to less than about 4, preferably less than 3, by the addition of a suitable inorganic or organic acid. By controlling the pH within these ranges, the components can be effectively dispersed into the inner part of the catalyst. Generally, it is preferred to use a halogenacid aqueous solution of the noble metals.

To enhance catalyst performance, it is also required to add a halogen component. Fluorine and chlorine are perferred halogen components. The halogen is contained on the catalyst within the range of 0.1 to 3 percent, preferably within the range of about 0.3 to 2 percent, based on the weight of the catalyst. When using chlorine as a halogen component, it is contained on the catalyst within the range of about 0.2 to 2 percent, preferably within the range of about 0.5 to 1.5 percent; based on the weight of the catalyst. The introduction of halogen into a catalyst can be carried out by any method and at any time of the catalyst preparation, for example, prior to, following or simultaneously with the impregnation of the platinum metal, and, e.g., the iridium, and rhenium components. In the usual operation, the halogen component is introduced simultaneously with the incorporation of the platinum metal component. It can also be introduced by contacting a carrier material in a vapor phase or liquid phase with a halogen compound such as hydrogen fluoride, hydrogen chloride, ammonium chloride, or the like.

The catalyst is dried by heating at a temperature above about 80° F., preferably between about 105° F., and 300° F., in the presence of nitrogen or oxygen, or both, in an air stream or under vacuum. The catalyst need not be calcined but if calcined at temperatures in excess of 600° F., it is generally preferred to calcine in atmospheres containing low partial pressures of oxygen or still more preferably in a non-reactive or inert gas such as nitrogen.

The reforming runs are initiated by adjusting the $C_8$+ aromatics content of a paraffinic naphtha blend, the hydrogen and feed rates, and the temperature and pressure of the catalyst filled reactors to operating conditions. The run is continued at optimum reforming conditions by adjustment of the major process variables, within the ranges described below.

| Major Operating Variables | Typical Process Conditions | Preferred Process Conditions |
|---|---|---|
| Pressure, Psig | 50–750 | 100–300 |
| Reactor Temp., °F. | 750–1100 | 850–1000 |
| Gas Rate, SCF/B (Incl. Recycle Gas) | 1500–10,000 | 2000–7000 |
| Feed Rate, W/W/Hr. | 0.5–10 | 1–3 |

The invention will be more fully understood by reference to the following demonstrations and examples which present comparative data illustrating its more salient features.

EXAMPLE

Tabulated below is the composition of four paraffinic naphthas. All are nominally $C_5$–$C_{10}$ hydrocarbon feedstocks.

| Carbon No. and Type of Hydrocarbons | Light Arab Naphtha (DBA) | Heavy Arab Naphtha (BWY) | Light Arab Naphtha-Fischer-Tropsch Naphtha (DBA/FTN) | Fischer-Tropsch Naphtha (FTN) |
|---|---|---|---|---|
| $C_6$ Wt. % | | | | |
| paraffins | 11 | 1 | 9 | 3 |
| naphthenes | 5 | 3 | 4 | 0 |
| aromatics | 1 | 2 | 1 | 0 |
| $C_7$ Wt. % | | | | |
| paraffins | 16 | 16 | 16 | 17 |

-continued

| Carbon No. and Type of Hydrocarbons | Light Arab Naphtha (DBA) | Heavy Arab Naphtha (BWY) | Light Arab Naphtha-Fischer-Tropsch Naphtha (DBA/FTN) | Fischer-Tropsch Naphtha (FTN) |
|---|---|---|---|---|
| naphthenes | 9 | 5 | 7 | 0 |
| aromatics | 3 | 2 | 2 | 0 |
| $C_8$+ Wt. % | | | | |
| paraffins | 29 | 43 | 41 | 80 |
| naphthenes | 16 | 11 | 12 | 0 |
| aromatics | 10 | 17 | 7 | 0 |

All four naphthas, as will be observed, are highly paraffinic, the paraffin content ranging from 56 wt. % for the Light Arab naphtha (DBA) to 100 wt. % for the Fischer-Tropsch naphtha (FTN). The Heavy Arab naphtha (BWY) and a blend of Light Arabian and Fischer-Tropsch naphthas (DBA/FTN) have paraffin contents of 60 and 66 wt. %, respectively. The naphthene and aromatic contents are also presented; both hydrocarbon types being absent from the Fischer-Tropsch naphtha. The variation in $C_8$+ aromatics content of each is also given with the Heavy Arab being greatest and the DBA/FTN blend the least.

The four naphthas were reformed over a common, commercial Pt-Re reforming catalyst; the nominal catalyst composition of which was 0.3 wt. % Pt-0.3 wt. % Re-1.0 wt. % Cl-0.1 wt. % S. Process conditions for all runs are those of a high pressure cyclic reformer set to produce a 100 RON reformate. The conditions and results of these tests, presented in Table I, show a 15 $C_5$+ LV% yield spread between the four paraffinic feeds, this clearly showing the advantages of high $C_8$+ aromatics content. The $C_5$+ liquid yield increase is further reflected between the runs in the decrease of $C_3$ and $C_4$ gases, the principal products of acid cracking reactions.

TABLE I

Cyclic Reforming of Paraffinic Naphthas With Pt—Re Catalyst
Nil Sulfur Naphtha,
950° F. E.I.T., 275 psig, 3700 SCF/B, 100 RON

| Naphtha | $C_5$+LV % @ 100 RON | $C_3/C_4$, Wt. % |
|---|---|---|
| Fischer-Tropsch (FTN) | 56.5 | 24.8 |
| Lt. Arab/Fischer-Tropsch (DBA/FTN) | 69.2 | 16.7 |
| Light Arab (DBA) | 71.2 | 5.1 |
| Heavy Arab (BWY) | 71.9 | 14.4 |

The $C_8$+ type hydrocarbons, it is apparent, is the major variable among the paraffin type hydrocarbons, but the observed yields fail to correlate with the $C_8$+ paraffin content of the naphthas. The highest $C_8$+ paraffin content feed, in fact, provides the lowest yield. Similarly, there is no correlation between yield and $C_8$+ naphthene content. The Heavy Arab and the blended naphtha thus have identical $C_8$+ naphthene contents, but yet the yields differ by nearly 3 LV% liquid yield. In a similar vein no yield correlation with total naphthene content exists.

However, the data show a clear dependence of yield on $C_8$+ aromatics content as acid cracking declines in response to increasing $C_8$+ aromatics in the feed. Reference is made to the FIGURE. The differences among the top three naphthas of Table I shown in The FIGURE are particularly striking, and show that yield responds to the $C_8$+ aromatics level of the naphtha feed. The aromatics benzene and toluene are not significant in this regard as these compounds are too weakly basic to interact with the catalyst acid sites. However, the data show a clear dependency on $C_8$+ aromatics content, and the absence of a correlation between yield and $C_6$, $C_7$ aromatics. The $C_8$+ aromatics fraction is clearly shown by the data to be the controlling variable.

It is apparent that various modifications and changes can be made without departing the spirit and scope of the present invention.

Having described the invention, what is claimed is:

1. In a process for reforming a paraffinic naphtha feed by introducing said feed, with hydrogen, into a reactor charged with a platinum-containing reforming catalyst, said paraffinic hydrocarbon naphtha feed containing from about 30 to about 100 wt. percent paraffinic hydrocarbons, from about 10 to about 70 wt. percent naphthenes, and from about 5 to about 30 wt. percent aromatics, of which less than about 5 wt. percent are $C_8$+ aromatics, and reacting said feed at reforming conditions.

the improvement comprising adding to the blend introduced to the reactor sufficient $C_8$+ aromatics to increase the $C_8$+ aromatics concentration of the feed introduced into the reactor to a level above about 5 wt. percent $C_8$+ aromatics to increase $C_5$+ liquid yield vis-a-vis said paraffinic naphtha feed otherwise similar except that no $C_8$+ aromatics are added, similarly reformed.

2. The process of claim 1 wherein sufficient $C_8$+ aromatics are added to the feed to raise the $C_8$+ aromatics concentration to a level above about 10 wt. percent $C_8$+ aromatics.

3. The process of claim 1 wherein sufficient $C_8$+ aromatics are added to the feed to raise the $C_8$+ aromatics concentration to a level ranging from about 5 wt. percent to about 20 wt. percent $C_8$+ aromatics.

4. The process of claim 1 wherein sufficient $C_8$+ aromatics are added to the feed to raise the $C_8$+ aromatics concentration to a level ranging from about 10 to about 15 wt. percent $C_8$+ aromatics.

5. In a process for reforming a paraffinic naphtha feed by introducing said feed, with hydrogen, into a reactor charged with a platinum-containing reforming catalyst, said paraffinic hydrocarbon naphtha feed containing from about 50 to about 100 wt. percent paraffinic hydrocarbons, from about 10 to about 60 wt. percent naphthenes, and from about 5 to about 20 wt. percent aromatics, of which less than about 5 wt. percent are $C_8$+ aromatics, and reacting said feed at reforming conditions, the improvement comprising adding to the blend introduced to the reactor sufficient $C_8$+ aromatics to increase the $C_8$+ aromatics concentration of the feed introduced into the reactor to a level above about 5 wt. percent $C_8$+ aromatics to increase $C_5$+ liquid yield vis-a-vis said paraffinic naphtha feed otherwise similar except that no $C_8$+ aromatics are added similarly reformed.

6. The process of claim 5 wherein sufficient $C_8$+ aromatics are added to the feed to raise the $C_8$+ aromatics concentration to a level above about 10 wt. percent $C_8$+ aromatics.

7. The process of claim 5 wherein sufficient $C_8$+ aromatics are added to the feed to raise the $C_8$+ aromatics concentration to a level ranging from about 5 wt. percent to about 20 wt. percent $C_8$+ aromatics.

8. The process of claim 5 wherein sufficient $C_8$+ aromatics are added to the feed to raise the $C_8$+ aromatics concentration to a level ranging from about 10 wt. to about 15 wt. percent $C_8$+ aromatics.

* * * * *